US006523648B2

(12) United States Patent
Bloch

(10) Patent No.: US 6,523,648 B2
(45) **Date of Patent: *Feb. 25, 2003**

(54) EMERGENCY LIGHTING IN ELEVATOR CARS WITH PHOSPHORESCENT MATERIALS

(75) Inventor: Hanspeter Bloch, Buchrain (CH)

(73) Assignee: Inventio AG, Hergiswil (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/511,856

(22) Filed: Feb. 23, 2000

(65) Prior Publication Data

US 2003/0006102 A1 Jan. 9, 2003

(30) Foreign Application Priority Data

Feb. 23, 1999 (EP) ..... 99810161

(51) Int. Cl.[7] ..... B66B 11/02

(52) U.S. Cl. ..... 187/414; 187/401

(58) Field of Search ..... 187/401, 414, 187/396, 397; 40/542; 362/84, 458

(56) References Cited

U.S. PATENT DOCUMENTS 3,808,499 A 4/1974 Edwards
5,412,542 A 5/1995 Mandy ..... 187/414 X

FOREIGN PATENT DOCUMENTS

JP 9 2 63 369 10/1997

*Primary Examiner*—Christopher P. Ellis
*Assistant Examiner*—Thuy V. Tran
(74) *Attorney, Agent, or Firm*—Cohen, Pontani, Lieberman & Pavane

(57) ABSTRACT

The interior of an elevator car is equipped with phosphorescent components which serve as emergency lighting in the case of power failure, and for facilitating activation of the alarm it contains relevant operating elements which have phosphorescent coatings or are made of materials with phosphorescent additives.

13 Claims, 2 Drawing Sheets

EMERGENCY LIGHTING IN ELEVATOR CARS WITH PHOSPHORESCENT MATERIALS

BACKGROUND OF THE INVENTION

1. Field of the Invention

The present invention relates to a device for assuring adequate emergency lighting, as well as sufficient visibility of alarm operating elements and instruction plates, in cars of passenger and freight elevators in case of power failure. Emergency lighting is necessary because, when there is a power failure, the elevator car can come to rest in a position where the passengers cannot leave it and remain trapped until the arrival of specialist assistance.

2. Discussion of the Prior Art

Most national and international elevator standards (as for example EN-81) require elevator installations to have emergency car lighting which switches on automatically if power failure occurs and which, being powered by a battery, guarantees a minimal level of lighting in the car for at least 1 hour.

U.S. Pat. No. 3,808,499 describes a battery-powered emergency supply unit for emergency lighting systems in elevator cars with functions such as charge voltage monitoring, charge level monitoring, charging rate control, power failure simulation, etc. Such, or similar, emergency lighting systems are nowadays built into practically all elevator cars.

Emergency lighting systems of the type described have a number of disadvantages. To keep their costs and installed weight low, their capacity is usually designed for the prescribed minimum power rating of 1 watt which must be delivered for a period of one hour. The resulting intensity of illumination is adequate to enable operation of certain devices such as an alarm button or intercom, but is often insufficient to prevent feelings of panic in passengers who are so disposed. Reading during the time of waiting until the elevator is released is practically impossible. In a fully occupied car, spreading of the light from the light source, which is usually in the form of a point, is usually hindered by passengers. Moreover, it can never be entirely ruled out that the emergency lighting device does not function when there is a power failure, especially since the emergency lamp can be relatively easily put out of action by vandals. In such a situation the passenger can neither read the relevant instruction plates, nor discern the alarm button or an intercom. Further disadvantages are that the status of these systems must be periodically checked, and that the batteries contained in them must be disposed of in a costly manner.

SUMMARY OF THE INVENTION

Accordingly, it is an object of the present invention to provide an emergency lighting device for elevator cars which fulfils the requirements specified in the regulations and does not have the disadvantages mentioned above.

According to the invention, this is achieved by affixing in the interior of the elevator cars in suitable positions phosphorescent materials in a suitable manner and in sufficient quantity. These are activated during operation of the elevator by the normal car lighting and, should this fail, the energy they have absorbed is emitted again in the form of visible light. This emission takes place in such a manner that the desired lighting effect is maintained for a period of more than an hour. An emergency lighting device according to the invention contains phosphorescent components with large area in the form of plastic foil parts, foils, or coats of paint (acrylic emulsion), which contain phosphorescent pigments as, for example, inorganic polycrystalline zinc sulfide.

By comparison with the prior art mentioned, this type of emergency lighting has considerable advantages.

Firstly, the phosphorescent sources of light with large surface achieve a much more even illumination of the elevator car than the usual 1-watt emergency lighting lamps in the form of a point. As already mentioned, this is especially the case when the car is fully occupied with passengers. Secondly, with modem fluorescent materials the rate of diminution of the light intensity is such that even after 3 hours enough light is emitted to prevent the occurrence of feelings of panic resulting from darkness. A third advantage is that emergency lighting of this type is extremely unsusceptible to faults, because it functions without wear and does not depend on an emergency power supply. The phosphorescent materials which are used permit a practically unlimited number of activation and emission cycles. No periodic check such as is required for emergency lighting with a lamp and an emergency power supply is required for this system. A further significant aspect is that a system of this type with phosphorescent components can be less easily put out of action by vandals than the emergency lighting lamps which are traditionally used.

There is separate inventive content in the phosphorescing construction of parts such as the emergency instruction plate, the alarm button, and the intercom. The advantage of such a construction is that these components are still legible or discernible even after several hours of power failure when the emission of light from the large surface of phosphorescent components serving as emergency lighting is no longer sufficient for this purpose.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
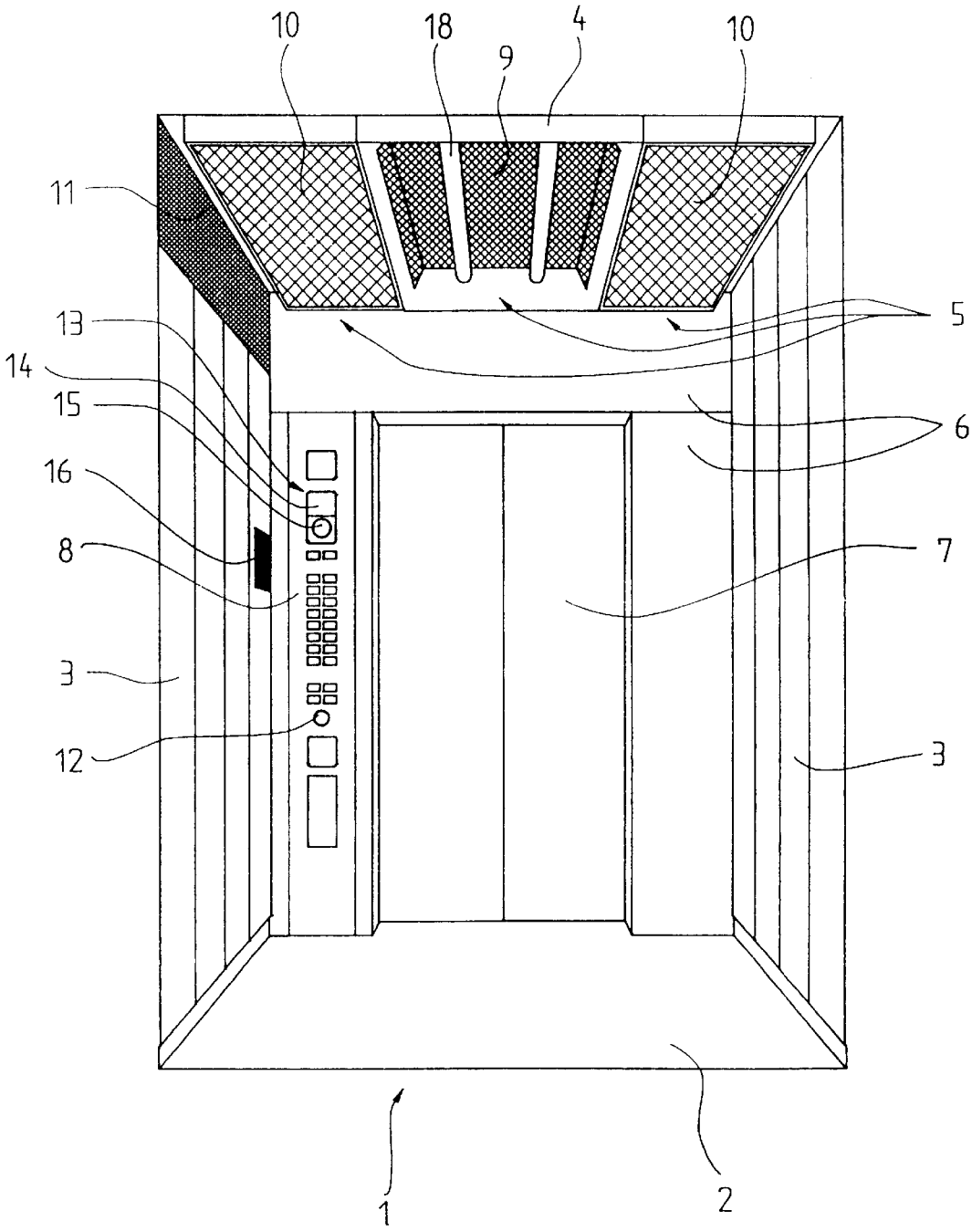
FIG. 1 is a view of the interior of an elevator car pursuant to the present invention.

FIG. 1 shows the interior of a passenger elevator car 1 according to the invention viewed from the rear wall (not visible) toward the car entrance. An elevator car consists essentially of a rigid car floor 2, two side walls 3, a rear wall, a car roof 4 with integral lighting 5, a car front 6 with automatic car doors 7 and an operating and display panel 8. In FIG. 1 the following phosphorescent components with a large surface which form part of the emergency lighting can be seen: the reflectors 9 belonging to the lighting device 5 integrated into the car roof and the lamp covers 10 which are described in more detail in the description of FIG. 2, as well as a lighting surface 11 at the upper edge of the left-hand car wall, which consists of either a self-adhesive phosphorescent PVC foil or of a coat of emulsion paint containing a phosphorescent pigment. Also shown in FIG. 1, and built into the operating and display panel 8, are the alarm button 12 and the intercom 13 with a microphone 14 and an activating button 15, all of which are marked with phosphorescent coatings in such a manner that after a power failure they are still discernible for several hours. The instruction plate 16 for breakdowns either has phosphorescent characters on a conventional plate, or conventional characters on a phosphorescent plate, and in case of power failure can therefore still be read after several hours.

Figures 2, 3:
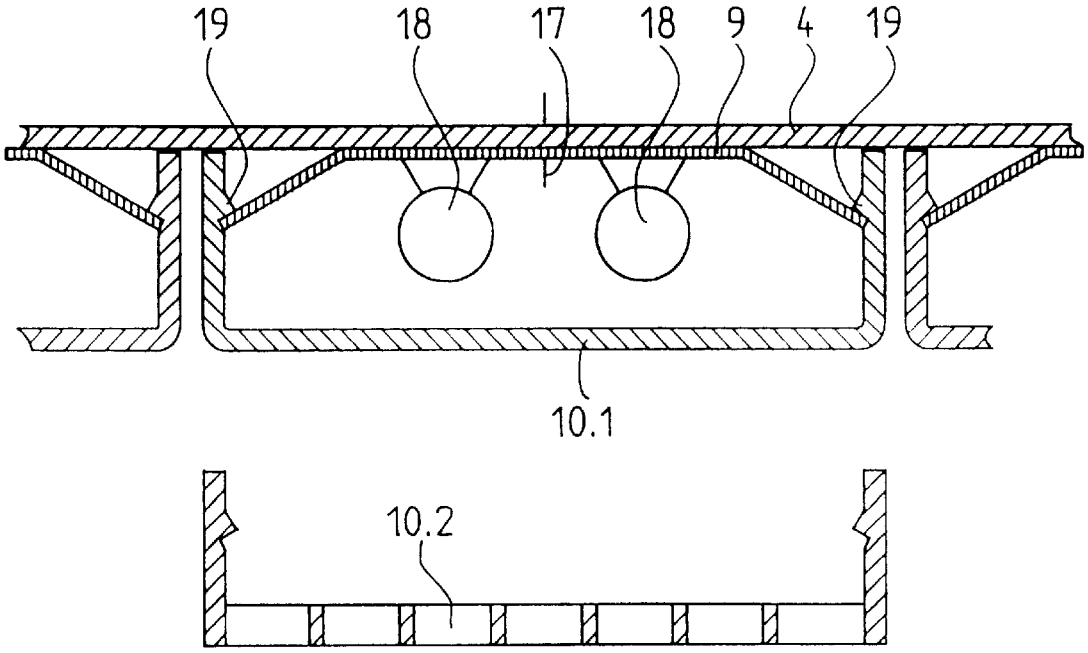
FIG. 2 is a detailed view of the lighting device of the elevator car in FIG. 1.
FIG. 3 shows another embodiment of a lamp cover of the lighting device in FIG. 2.

FIG. 2 shows in detail the lighting device 5 integrated in the car roof. Fastened to the car roof with bolts 17 is the reflector 9 which also serves as a mounting for fluorescent tubes 18. This reflector 9 is coated with a coat of emulsion paint which contains phosphorescent pigments. Below the fluorescent tubes 18 and held by the reflector 9 with snap connectors 19 are the lamp covers 10 which are made of a transparent plastic material which also contains phosphorescent pigments. These lamp covers 10 can be constructed as decorative elements with a wide range of different shapes, for instance as a closed diffuser 10.1 or as a grille 10.2 (see FIG. 3). With the arrangement described here of the phosphorescent elements immediately adjacent to the fluorescent tubes 18, their phosphorescent pigments are optimally activated which, is extremely important for prolonged luminescence in case of power failure.

It goes without saying that the present list of possible constructions of the phosphorescent components, as well as the positions in which they are affixed and the ways in which they are fastened, is not definitive.

The invention is not limited by the embodiments described above which are presented as examples only but can be modified in various ways within the scope of protection defined by the appended patent claims.

I claim:

1. A car for an elevator installation comprising: a ceiling having an area; a lighting installation including a light source for normal operation; and emergency lighting for illuminating an interior of the car in power failure situations, the emergency lighting including at least one of large-surface phosphorescent car wall surfaces and large-surface phosphorescent car components, the large-surface phosphorescent car wall surfaces and the large-surface phosphorescent car components being configured to cumulatively cover an interior area of the car equal to at least half the area of the ceiling of the car, the phosphorescent car wall surfaces and the large-surface phosphorescent car components being arranged in close proximity to the light source.

2. A car for an elevator installation according to claim 1, and further comprising an alarm device having an operating element that serves to activate an alarm, the operating element being coated with phosphorescent material.

3. A car for an elevator installation according to claim 1, and further comprising an alarm device having an operating element that serves to activate an alarm, the operating element consisting of materials which contain phosphorescent additives.

4. A car for an elevator installation according to claim 1, wherein the emergency lighting includes instruction plates having phosphorescent characters on a non-phosphorescent plate.

5. A car for an elevator installation according to claim 1, wherein the emergency lighting includes instruction plates having nonphosphorescent characters on a phosphorescent plate.

6. A car for an elevator installation according to claim 1, wherein the phosphorescent surfaces in the interior include self-adhesive plastic foils containing phosphorescent pigments.

7. A car for an elevator installation according to claim 1, wherein the phosphorescent surfaces in the interior have a coat of paint which contains phosphorescent pigments.

8. A car for an elevator installation according to claim 1, wherein the lighting installation includes fluorescent tubes and a reflector arranged above the tubes, the emergency lighting including phosphorescent plastic foils arranged on the reflector.

9. A car for an elevator installation according to claim 1, wherein the lighting installation includes fluorescent tubes and a reflector arranged above the tubes, the emergency lighting including a coat of paint on the reflector which contains phosphorescent pigments.

10. A car for an elevator installation according to claim 1, wherein the lighting installation includes fluorescent tubes and light grills arranged below the tubes which grills are made of a material which contains phosphorescent pigments.

11. A car for an elevator installation according to claim 1, wherein the lighting installation includes fluorescent tubes and light grills arranged below the tubes which grills have a coat of paint which contains phosphorescent pigments.

12. A car for an elevator installation according to claim 1, wherein the lighting installation includes fluorescent tubes and transparent covers arranged below the tubes which grills are made of a material which contains phosphorescent pigments.

13. A car for an elevator installation according to claim 1, wherein the lighting installation includes fluorescent tubes and transparent covers arranged below the tubes which covers have a coat of paint which contains phosphorescent pigments.

* * * * *